US011562719B2

(12) United States Patent
Nakaya

(10) Patent No.: US 11,562,719 B2
(45) Date of Patent: Jan. 24, 2023

(54) BOW HAIR MATERIAL AND BOW FOR BOWED STRING INSTRUMENT

(71) Applicant: Yamaha Corporation, Hamamatsu (JP)

(72) Inventor: Hiroshi Nakaya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/141,317

(22) Filed: Jan. 5, 2021

(65) Prior Publication Data

US 2021/0151013 A1 May 20, 2021

Related U.S. Application Data

(63) Continuation of application No. PCT/JP2018/026295, filed on Jul. 12, 2018.

(51) Int. Cl.
*G10D 3/16* (2020.01)

(52) U.S. Cl.
CPC ..... *G10D 3/16* (2013.01)

(58) Field of Classification Search
CPC ..... G10D 3/16; G10D 3/00
See application file for complete search history.

(56) References Cited

U.S. PATENT DOCUMENTS

| | | | | |
|---|---|---|---|---|
| 4,040,322 | A * | 8/1977 | Parkyns | G10D 3/16 84/282 |
| 2002/0058738 | A1* | 5/2002 | Quinn | C08K 3/08 524/440 |
| 2012/0029135 | A1* | 2/2012 | Kim | D01F 1/04 524/451 |
| 2014/0311316 | A1 | 10/2014 | Nesbitt | |

FOREIGN PATENT DOCUMENTS

| | | | |
|---|---|---|---|
| JP | 51-78215 | A | 7/1976 |
| JP | 1-82069 | U | 6/1989 |
| JP | 1-195873 | A | 8/1989 |
| WO | WO 2017/163469 | A1 | 9/2017 |

OTHER PUBLICATIONS

International Search Report (PCT/ISA/210) issued in PCT Application No. PCT/JP2018/026295 dated Aug. 21, 2018 with English translation (four (4) pages).

Japanese-language Written Opinion (PCT/ISA/237) issued in PCT Application No. PCT/JP2018/026295 dated Aug. 21, 2018 (four (4) pages).

English translation of (Japanese-language Written Opinion (PCT/ISA/237) filed on Jan. 5, 2021) issued in PCT Application No. PCT/JP2018/026295 dated Aug. 21, 2018 (six (6) pages).

Japanese-language Office Action issued in Japanese Application No. 2020-529907 dated Sep. 7, 2021 with English translation (11 pages).

* cited by examiner

*Primary Examiner* — Kimberly R Lockett

(74) *Attorney, Agent, or Firm* — Crowell & Moring LLP

(57) ABSTRACT

A bow hair material for a bow hair of a bow of a bowed string instrument. The bow hair material includes threads constructed from poly phenylene sulfide resin. The bow material may be formed into a hair bundle that includes a plurality of threads that are substantially parallel with each other. A mounting portion may be formed by welding an end portion of the hair bundle that mounts the hair bundle on a frog or stick of the bow.

7 Claims, 8 Drawing Sheets

BOW HAIR MATERIAL AND BOW FOR BOWED STRING INSTRUMENT

CROSS-REFERENCE TO RELATED APPLICATIONS

The present application is a continuation application of International Application No. PCT/JP2018/026295, filed Jul. 12, 2018, the contents of which are incorporated herein by reference.

BACKGROUND OF THE INVENTION

Field of the Invention

The present subject matter relates to a bow hair material, which is used for a bow hair of a bow for a bowed string instrument, and the bow for a bowed string instrument.

Description of Related Art

A bow for a bowed string instrument used for playing a stringed instrument such as a violin has a stick, a bow hair, and a screw that adjusts the tension of the bow hair. The bow for a bowed string instrument is used with the tension of the bow hair made high when playing. After playing, the tension of the bow hair is relaxed and the stick is released from a force generated by pulling by the bow hair. The bow for a bowed string instrument is used in a state where pine resin is adhered to the bow hair.

In recent years, hair from the tail of a horse has been mainly used as a material for the bow hair of the bow for a bowed string instrument.

A bow using a bow hair made of polyvinylidene fluoride (PVDF) is described as a bow for a bowed string instrument in PCT International Publication No. 2017/163469 (hereinafter referred to as Patent Document 1).

SUMMARY OF THE INVENTION

However, the bow hair formed by mounting the hair of the tail of the horse has insufficient durability. For this reason, it is necessary for a user of the bow for a bowed string instrument using the hair of the tail of the horse as a material for the bow hair (bow hair material) to frequently replace the bow hair (hair replacement). In addition, the hair of the tail of the horse undergoes a large dimensional change caused by a humidity change. For this reason, in the bow for a bowed string instrument using the hair of the tail of the horse as a bow hair material, even when the screw is rotated to change the tension of the bow hair, the tension of the bow hair may not be adjusted to tension suitable for playing in some cases, depending on the humidity in an environment.

The bow hair material made of PVDF has good durability compared to the hair of the tail of the horse. However, in the bow for a bowed string instrument having the bow hair made of PVDF, there is a possibility that the stick deforms or breaks when the temperature of the bow hair becomes higher due to an external effect. More specifically, the bow hair made of PVDF greatly contracts with a temperature rise and the tension of the bow hair becomes higher. A force generated by pulling by the bow hair is applied to the stick. Thus, there is a possibility that the stick deforms or breaks. For this reason, decreasing a dimensional change caused by a temperature change is required for the bow hair material made of PVDF.

The present subject matter has been conceived in view of the points described above. An example of an object of the present subject matter is to provide a bow hair material used for a bow hair of a bow for a bowed string instrument, the bow hair material being good in durability and undergoing a small dimensional change caused by a temperature change and a humidity change.

A bow hair material according to an aspect of the present subject matter is used for a bow hair of a bow for a bowed string instrument and includes hair including poly phenylene sulfide resin.

A bow for a bowed string instrument according to another aspect of the present subject matter includes: a stick; and a bow hair comprising the bow hair material and mounted on the stick.

A manufacturing method of a bow hair material used for a bow hair of a bow for a bowed string instrument according to still another aspect of the present subject matter includes: forming a hair bundle that includes a plurality of hairs including poly phenylene sulfide resin, the plurality of hairs being substantially parallel with each other; and welding an end portion of the hair bundle to form a mounting portion for mounting the hair bundle on a frog of the bow or a head of a stick of the bow.

DETAILED DESCRIPTION OF THE DRAWINGS

Figure 1:
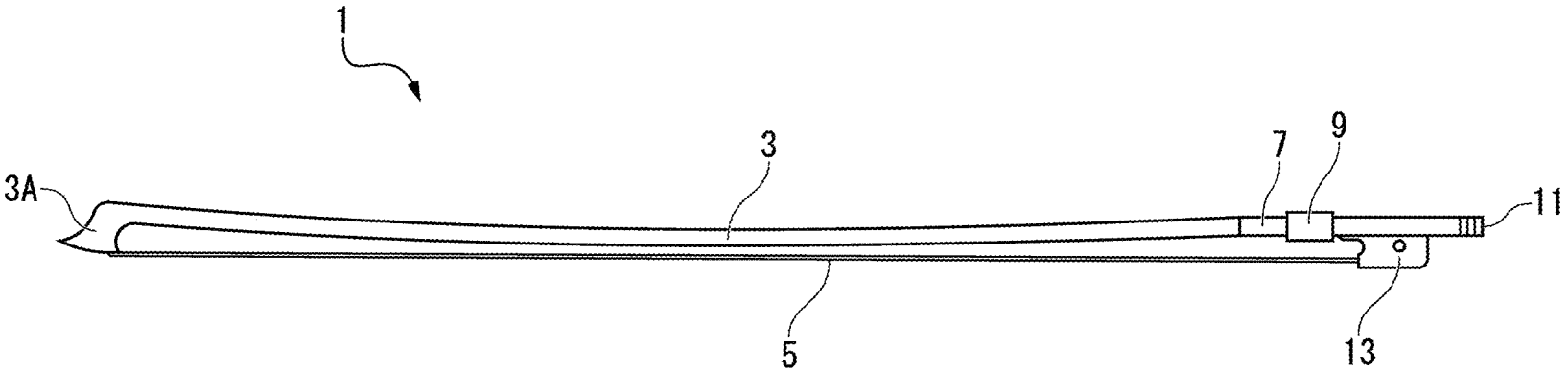
FIG. 1 is a plan view illustrating a bow for a bowed string instrument of an embodiment.

Hereinafter, a bow hair material and a bow for a bowed string instrument according to the embodiment of the present subject matter will be described in detail.

[1. Bow Hair Material]

The bow hair material of the embodiment is a bow hair material used for a bow hair of the bow for a bowed string instrument. The bow hair material of the embodiment includes hair made of (including) poly phenylene sulfide (PPS) resin.

As the hair made of PPS resin, hair having a substantially circular section and a substantially uniform diameter (outer diameter) in a length direction can be used. Specifically, commercially available fibers (threads) made of PPS resin can be used as the hair of the bow hair material of the embodiment.

The hair made of PPS resin included in the bow hair material of the embodiment has the easiness of adhering pine resin, which is equal to or higher than hair from the tail of a horse (hereinafter, referred to as a "horse hair" in some cases). For this reason, the bow for a bowed string instrument that includes the bow hair using the bow hair material of the embodiment can be used in a state where pine resin is adhered to the bow hair, as in the same manner as a case of using the horse hair as a bow hair material. Therefore, the bow hair material of the embodiment is preferable as a bow hair material since the bow for a bowed string instrument that includes the bow hair using the bow hair material is similar to a case where the horse hair is used as a bow hair material, in terms of a tactile sense of playing and sound generation.

The hair made of PPS resin included in the bow hair material of the embodiment has a diameter of preferably 0.1 to 0.3 mm, more preferably 0.15 to 0.25 mm, and even more preferably 0.15 to 0.20 mm. When the diameter of the hair made of PPS resin is within the range, the bow for a bowed string instrument that includes the bow hair using the bow hair material of the embodiment is more similar to a case where the horse hair is used as a bow hair material, in terms of a tactile sense of playing and sound generation. In addition, when the diameter of the hair made of PPS resin is within the range, the range of the diameter of the hair made of PPS resin is approximately the same as a range of a diameter of the horse hair, which is preferable. In addition, when the diameter of the hair made of PPS resin is 0.1 mm or more, the hair has good tensile strength.

Characteristics of the hair made of PPS resin included in the bow hair material of the embodiment are as follows. An inclination, or slope, of a tensile force-elongation curve within a range where a tensile force is 0.2 N or more and an elongation amount is 1% or less is preferably 0.70 to 1.70 N/%, and more preferably 0.80 to 1.60 N/%. With a bow for a bowed string instrument that includes a bow hair using the hair of which the inclination of the tensile force-elongation curve is 0.70 to 1.70 N/%, a tactile sense of playing and sound generation similar to the bow for a bowed string instrument that includes the bow hair using the horse hair can be obtained for the following reasons.

With a bow for a bowed string instrument having an elongation amount of the bow hair when a tensile force caused by playing the instrument is applied, which is similar to an elongation amount of the bow hair using the horse hair, a tactile sense of playing and sound generation similar to the bow for a bowed string instrument that includes the bow hair using the horse hair can be obtained. In general, when playing, a tensile force of 0.3 N to 0.8 N is applied to the bow hair of the bow for a bowed string instrument. The elongation amount of the horse hair at a tensile force of 0.8 N is 1% or less. Therefore, a tensile force range of a tensile force-elongation curve of the horse hair within a range where a tensile force is 0.2 N or more and an elongation amount is 1% or less includes a tensile force range applied to the bow hair when playing. In addition, an inclination of the tensile force-elongation curve of the horse hair within a range where a tensile force is 0.2 N or more and an elongation amount is 1% or less is 0.80 to 0.95 N/%.

The hair, of which the inclination of the tensile force-elongation curve within a range where a tensile force is 0.2 N or more and an elongation amount is 1% or less is 0.70 to 1.70 N/%, has a similar inclination of the tensile force-elongation curve of the horse hair. For this reason, the bow hair using the hair of which the inclination of the tensile force-elongation curve is 0.70 to 1.70 N/% has an elongation amount when a tensile force caused by playing is applied similar to the elongation amount of the bow hair using the horse hair. From this, the bow for a bowed string instrument that includes the bow hair using the hair of which the inclination of the tensile force-elongation curve is 0.70 to 1.70 N/% can obtain a tactile sense of playing and sound generation similar to the bow for a bowed string instrument that includes the bow hair using the horse hair.

The inclination of the tensile force-elongation curve within the range where the tensile force is 0.2 N or more and an elongation amount is 1% or less can be adjusted through the thickness of the hair made of PPS resin. Therefore, by changing the thickness of the hair made of PPS resin depending on the preference of a player, a tactile sense of playing and sound generation of the bow for a bowed string instrument that includes the bow hair using the bow hair material of the embodiment can be adjusted. Specifically, the inclination of the tensile force-elongation curve increases as the hair made of PPS resin becomes greater. When the diameter of the hair made of PPS resin is 0.1 to 0.3 mm, the inclination of the tensile force-elongation curve is likely to be within a range of 0.70 to 1.70 N/%.

The hair made of PPS resin preferably has tensile strength (tensile strength in a longitudinal direction) of 4 N or more. When the tensile strength of the hair made of PPS resin is 4 N or more, the bow hair material has good tensile strength. Thus, the durability of the bow hair material is further improved. On the other hand, the tensile strength of the horse hair is 2 to 3 N. The tensile strength of the hair made of PPS resin is preferably 12 N or less, and more preferably 10 N or less. When the tensile strength of the hair made of PPS resin is 12 N or less, the hair made of PPS resin having a thickness preferable as a bow hair material can be used. Accordingly, an external shape of the bow hair using the bow hair material of the embodiment is similar to the bow hair using the horse hair, and a tactile sense of playing and sound generation of the bow for a bowed string instrument including the bow hair are similar to the bow hair using the horse hair, which is preferable.

The tensile strength of the hair made of PPS resin becomes higher as the hair becomes thicker. For example, in a case where the diameter of the hair made of PPS resin is 0.15 mm, the tensile strength is 5 to 7 N. In a case where the diameter is 0.20 mm, the tensile strength is 9 to 12 N.

As hair made of PPS resin, it is preferable that the number of reciprocations of the bow for a bowed string instrument until the number of cut hairs amounts to 20% shown below be 200,000 or more.

"The number of reciprocations of the bow for a bowed string instrument until the number of cut hairs amounts to 20%" in the embodiment means that a bow for a bowed string instrument that includes a bow hair using 100 to 220 hairs made of PPS resin as a bow hair material is created, a weight having a total weight of 25 g on the stick in a bowing range is disposed such that a load distribution in the bowing range is substantially equal, and in a case where the D string, which is a violin string, is rubbed by the bow hair, the number of reciprocations of the bow for a bowed string instrument until 20% of the number of hairs out of the hair forming the bow hair is cut.

When the number of reciprocations of the bow for a bowed string instrument until the number of cut hairs made of PPS resin amounts to 20% is 200,000 times or more, the bow hair material has good wear resistance, and thus the durability of the bow hair material is further preferable. On the other hand, the number of reciprocations of the bow for a bowed string instrument until the number of cut horse hairs amounts to 20% is 100,000 times or less.

The hair made of PPS resin undergoes a small dimensional change caused by a temperature change. For this reason, in the bow for a bowed string instrument that includes the bow hair using the bow hair material of the embodiment, a force generated by pulling by the bow hair is unlikely to be applied to the stick as the contraction of the bow hair caused by the temperature change is small, which is preferable.

A temperature of the bow hair in the bow for a bowed string instrument is a high temperature due to external effects in some cases. Specifically, the temperature of the bow hair becomes a temperature of 70° C. or more in some cases due to the bow for a bowed string instrument being warmed by direct sunlight or a temperature inside a car, in which the bow for a bowed string instrument is placed, becoming high.

In a case where the hair made of PPS resin is kept at a temperature of 70° C., the hair reaches a steady state with a keeping time less than five hours. In the hair made of PPS resin, an elongation/contraction rate of the length the hair which has kept at a temperature of 70° C. for, for example, five hours or more with respect to the length of the hair at the room temperature ({a difference between lengths before and after being kept at 70° C./a length before being kept at 70° C.)}×100(%)) is preferably 0.5% or less, and more preferably 0.3% or less when the hair is kept at 70° C. The lower the elongation/contraction rate, the better. In a case where the elongation/contraction rate is 0.5% or less, an excessive force caused by pulling by the bow hair is prevented from impairing the quality of the stick even when the temperature of the bow hair is 70° C. or more in the bow for a bowed string instrument that includes the bow hair using the bow hair material of the embodiment.

In the embodiment, the room temperature means a temperature range of 15 to 25° C.

The hair made of PPS resin undergoes a small dimensional change caused by a humidity change. For this reason, even when the length of the bow hair is changed due to the humidity change in the bow for a bowed string instrument that has the bow hair using the bow hair material of the embodiment, for example, the bow hair can be adjusted to have tension suitable for playing easily by rotating a screw.

For example, in the hair made of PPS resin, a change amount of a length dimension within a humidity range of 20 to 95% is preferably 0.5% or less, and more preferably 0.3% or less. The smaller the change amount, the better. In a case where the hair made of PPS resin has a change amount of a length dimension within a humidity range of 0 to 100% of 0.5% or less, in the bow for a bowed string instrument that has the bow hair using the bow hair material of the embodiment, for example, the bow hair can be adjusted to have tension suitable for playing easily by rotating a screw even when the length of the bow hair changes due to a humidity change.

A color of the hair made of PPS resin may be white, or the hair may be colored black, gray, or gold. As a method for coloring the hair made of PPS resin, a known coloring method can be used and the method is not particularly limited. For example, a bow hair material using black-colored hair as hair made of PPS resin can be used for the same application as in the case of using a black horse hair as a bow hair material. The hair made of PPS resin may be color-coded depending on a thickness.

The bow hair material of the embodiment may have a hair bundle including a plurality of the hairs made of PPS resin which are arranged in the length direction. It is preferable that, by welding an end portion of the hair bundle, a mounting portion for mounting the hair bundle on a frog of the bow for a bowed string instrument or a head of the stick be formed on the bow hair material of the embodiment.

The shape and size of the mounting portion may be a shape and a size, which allow mounting the hair bundle on the head and the frog of the bow for a bowed string instrument. A shape of the mounting portion is preferably, for example, a rectangular shape in plan view that has a width which is 2 to 3 mm narrower than widths of the head and the frog of the bow for a bowed string instrument and a length of 3 to 5 mm from an end of the hair bundle.

In a case where the bow hair material of the embodiment has the mounting portion, the mounting portion can be manufactured, for example, through a manufacturing method described below.

First, a hair bundle including a plurality of hairs made of poly phenylene sulfide resin with their length directions being aligned is formed (hair bundle forming step). Next, the end portion of the hair bundle is welded to form the mounting portion for mounting the hair bundle on the frog of the bow for a bowed string instrument or the head of the stick (welding step).

In the welding step, a method of using an infrared laser and/or an ultrasonic wave can be given as an example of a method of welding the end portion of the hair bundle including the plurality of the hairs made of PPS resin. PPS resin is thermoplastic resin, and the hair made of PPS resin can be easily welded through the method of using an infrared laser and/or an ultrasonic wave. For this reason, a welded portion can be easily and efficiently formed by welding the end portion of the hair bundle including the plurality of the hairs made of PPS resin.

The mounting portion may be formed on both end portions of the hair bundle, or may be formed on only one end portion. That is, the mounting portion may have a first mounting portion provided at one end portion of the hair bundle and a second mounting portion provided at the other end portion, or may have only the first mounting portion.

In a case where the mounting portion has the first mounting portion and the second mounting portion, the plurality of the hairs disposed between the first mounting portion and the second mounting portion are preferably arranged such that the hairs are substantially parallel to each other in the length direction. Consequently, the plurality of the hairs included in the hair bundle are unlikely to intersect with each other when the first mounting portion and the second mounting portion are disposed with a maximum distance therebetween. Accordingly, the bow hair material can be easily mounted on the frog of the bow for a bowed string instrument and the head of the stick, and the playability of the bow for a bowed string instrument that has the bow hair using the bow hair material is improved.

The length of each hair forming the hair bundle is preferably 400 to 750 mm. When the length of each hair is within the range of 400 to 750 mm, the hair is suitable as a bow hair material stretched by a bow of a stringed instrument of any of a violin, a viola, a cello, a contrabass, and small fractional instruments thereof.

The number of the hairs forming the hair bundle is preferably 100 to 220. When the number of the hairs forming the hair bundle is in the range of 100 to 220, the hair is suitable in a case where one hair bundle is used as the bow hair material of one bow for a bowed string instrument.

The hair bundle includes the plurality of the hairs made of PPS resin. The plurality of the hairs forming the hair bundle may be only one type of hair made of PPS resin, or may include two or more types of hairs having any one or more different qualities of, for example, a thickness, color, and a material. In a case where the hair bundle includes two or more types of hairs, a combination of the types of hairs and a usage proportion can be determined as appropriate depending on the playability and sound generation of the bow for a bowed string instrument, application, an external shape of the bow hair, and the preference of the player.

In a case where the hair bundle includes hair made of another material other than PPS resin, the horse hair may be used as the hair made of another material, or hair made of nylon, polyester, PVDF, and resin such as polyethylene terephthalate (PET) may be used.

A proportion of the number of the hairs made of PPS resin, out of the plurality of the hairs forming the hair bundle, may be preferably 50% or more, more preferably 80% or more, or may be 100%. By using a bow hair material of which a proportion of the number of hairs made of PPS resin is 50% or more, out of the plurality of hairs forming a hair bundle, a bow hair, which is even more preferable in terms of durability and undergoes a smaller dimensional change caused by a temperature change and a humidity change, can be formed.

The bow hair material of the embodiment can be mounted on the frog of the bow for a bowed string instrument and the head of the stick in the same manner as in a case where the horse hair is used as the bow hair material.

The bow hair material can be mounted on the bow for a bowed string instrument through a method described below when the bow hair material of the embodiment has the first mounting portion provided at one end portion of the hair bundle and the second mounting portion provided at the other end portion as the mounting portion for mounting the hair bundle on the head or the frog of the stick of the bow for a bowed string instrument and the plurality of the hairs disposed between the first mounting portion and the second mounting portion are arranged such that the hairs are arranged substantially parallel to each other in the length direction.

That is, the first mounting portion is fitted into the head of the stick of the bow for a bowed string instrument and is fixed with a wedge. Next, the second mounting portion is fitted into the frog of the bow for a bowed string instrument, and is fixed with a wedge. After then, the frog is attached to the bow for a bowed string instrument.

In a case where the bow hair material of the embodiment has the first mounting portion and the second mounting portion, it is not necessary to perform the following operations (1) to (4), which are performed in a case where the horse hair is used as a bow hair material. Therefore, by using the bow hair material of the embodiment, the bow hair in the bow for a bowed string instrument can be efficiently and easily attached.

(1) An operation of selecting a horse hair to be used for a bow hair by removing an excessively thick hair, an excessively thin hair, and a damaged hair from a plurality of the horse hairs.

(2) An operation of making a hair bundle of the selected horse hair, tying an end portion of the hair bundle with a thread, cutting a tip, and hardening with pine resin.

(3) An operation of combing and arranging the horse hair which forms the hair bundle after fixing one end of the hair bundle of the horse hair to the frog.

(4) An operation of adjusting the length and tension of the hair bundle when fixing the bow hair material to the bow for a bowed string instrument, in consideration of a dimensional change of the horse hair caused by a humidity change.

In a case where the bow hair material of the embodiment is used, it is not necessary to perform the operations (1) and (4) regardless of the presence or absence of the mounting portion for mounting the hair bundle on the frog of the bow for a bowed string instrument or the head of the stick.

The horse hair undergoes a large dimensional change caused by a humidity change. For this reason, it is necessary to consider a dimensional change in the horse hair caused by a humidity difference between a humidity environment when an operation of fixing the bow hair material to the bow for a bowed string instrument is performed and a humidity environment when the bow for a bowed string instrument is actually used. Accordingly, in a case where the horse hair is used as a bow hair material, the operation (4) is essential. On the other hand, the hair made of PPS resin undergoes a small dimensional change caused by a humidity change compared to the horse hair, and it is not necessary to consider a dimensional change caused by a humidity change. Therefore, it is not necessary to perform the operation (4).

In addition, the hair bundle including the plurality of the hairs made of PPS resin can be more easily and efficiently bundled through welding. For this reason, even when the bow hair material of the embodiment does not have the mounting portion, the end portion of the hair bundle can be easily and efficiently bundled through welding instead of the operation (2) of tying the end portion of the hair bundle with a thread and hardening with pine resin. Therefore, even when the bow hair material of the embodiment does not have the mounting portion, the bow hair in the bow for a bowed string instrument can be efficiently and easily attached, compared to a case where the horse hair is used.

In addition, a bow hair material made of PVDF is unlikely to be welded. Therefore, the bow hair material of the embodiment can efficiently and easily attach the bow hair in the bow for a bowed string instrument even when compared to the bow hair material made of PVDF.

In a case where the bow hair material of the embodiment has only the first mounting portion or in a case where the bow hair material does not have any mounting portion, it is necessary to perform the operation (3). However, in a case where hair that has a substantially circular section and a substantially uniform diameter (outer diameter) in the length direction is used as hair made of PPS resin, the operation (3) can be efficiently performed compared to a case where the horse hair is used as a bow hair material as will be described below.

That is, each horse hair has different undulations and curls, undergoes a large change in a diameter in the length direction and has unevenness caused by cuticles on a surface. For this reason, in the hair bundle of the horse hair, the respective hairs are easily entangled with each other.

On the other hand, the hair bundle including the plurality of the hairs made of PPS resin is unlikely to be entangled compared to the hair bundle of the horse hair, and the operation of combing and arranging the hair forming the hair bundle can be easily performed.

[2. Bow for Bowed String Instrument]

FIG. 1 is a plan view illustrating the bow for a bowed string instrument of the embodiment. A bow for a bowed string instrument 1 illustrated in FIG. 1 is used in playing a stringed instrument such as a violin, a viola, a cello, and a contrabass. The bow for a bowed string instrument 1 illustrated in FIG. 1 includes a stick 3, a bow hair 5, a winding wire 7, a thumb grip 9, a screw 11, and a frog (hair box) 13.

The bow hair 5 is stretched between a head 3A of the stick 3 and the frog 13. The bow for a bowed string instrument 1 illustrated in FIG. 1 is brought into a state where the tension of the bow hair 5 is high such that the bow can be used in playing a stringed instrument. The bow hair 5 has a strip-like planar shape extending in a length direction of the stick 3, and one surface thereof is disposed to face the stick 3. As illustrated in FIG. 1, the stick 3 is warped with a predetermined curvature. For this reason, an interval between the stick 3 and the bow hair 5 is wide on a head 3A side and a frog 13 side and is narrow at a central portion in the length direction.

The bow hair 5 is made of (includes) a plurality of hairs stretched side by side substantially parallel to the length direction of the stick 3. The bow hair material of the embodiment, including the hair made of PPS resin, is mounted on the bow hair 5 of the bow for a bowed string instrument 1 illustrated in FIG. 1.

The number of the hairs forming the bow hair 5 is preferably 100 to 220, and more preferably 120 to 200. The number of the hairs forming the bow hair 5 can be determined as appropriate depending on the application of the bow for a bowed string instrument 1, the thickness of each hair forming the bow hair 5, and the preference of the player.

The stick 3 may be made of wood such as Pernambuco wood or may be made of fiber reinforced plastic. As fiber reinforced plastic, glass fiber reinforced plastic and carbon fiber reinforced plastic can be used. A stick made of fiber reinforced plastic has high strength and has good weather resistance and dimensional stability compared to the stick made of wood.

The bow for a bowed string instrument 1 illustrated in FIG. 1 can be manufactured through a similar method for a bow for a bowed string instrument of the related art using the horse hair as a bow hair material, except that the bow hair material of the embodiment is used as a material for the bow hair 5.

Compared to a case where the horse hair is used as a bow hair material, the bow hair can be efficiently and easily attached in the bow for a bowed string instrument 1 illustrated in FIG. 1 since the bow hair 5 is formed using the bow hair material of the embodiment.

The bow for a bowed string instrument 1 illustrated in FIG. 1 includes the bow hair 5 on which the bow hair material of the embodiment including the hair made of PPS resin is mounted. For this reason, the bow for a bowed string instrument 1 illustrated in FIG. 1 has the bow hair 5, which has good tensile strength and good wear resistance, and has good durability compared to the bow having the bow hair made of the horse hair. Therefore, the bow for a bowed string instrument 1 illustrated in FIG. 1 needs hair replacement with a low frequency compared to the bow including the bow hair made of the horse hair.

In addition, the bow hair material of the embodiment, including the hair made of PPS resin, has a small elongation/contraction rate at a high temperature. For this reason, in the bow for a bowed string instrument 1 illustrated in FIG. 1 that includes the bow hair 5 using the bow hair material according to the embodiment of the present subject matter, a force generated by pulling by the bow hair 5 that is applied to the stick 3 is small as the contraction of the bow hair caused by a temperature change is small, and the stick 3 is unlikely to be deformed or broken.

In addition, the bow hair material of the embodiment, including the hair made of PPS resin, undergoes a small dimensional change caused by a humidity change. For this reason, a change in the length of the bow hair 5 caused by a humidity change is small. Even when the length of the bow hair 5 changes due to a humidity change, the bow for a bowed string instrument 1 illustrated in FIG. 1 that includes the bow hair 5 using the bow hair material according to the embodiment of the present subject matter can adjust the tension of the bow hair 5 to tension suitable for playing, for example, by rotating the screw 11.

In addition, pine resin is likely to adhere to the bow hair 5 included in the bow for a bowed string instrument 1 illustrated in FIG. 1 to an equal or higher degree than to the bow hair made of the horse hair. For this reason, the bow for a bowed string instrument 1 illustrated in FIG. 1 has a tactile sense of playing and sound generation which are similar to the bow for a bowed string instrument using the horse hair as a bow hair material. Therefore, the bow for a bowed string instrument 1 illustrated in FIG. 1 is unlikely to give a feeling of strangeness to the player using the bow for a bowed string instrument 1 as a case where the bow for a bowed string instrument including the bow hair made of the horse hair is used, which is preferable.

Further, in a case where the bow hair 5 of the bow for a bowed string instrument 1 illustrated in FIG. 1 uses the bow hair material including the hair made of PPS resin with a diameter of 0.1 to 0.3 mm, the hair of which an average inclination of the tensile force-elongation curve within a range where an elongation amount is 0 to 1% is 0.70 to 1.70 N/%, a tactile sense of playing and sound generation which are similar to the bow for a bowed string instrument using the horse hair as a bow hair material can be obtained.

Working Examples

Hereinafter, the present subject matter will be described in detail with reference to working examples. The present subject matter is not limited to the working examples described below as long as it departs from the concept thereof.

Tensile Test

Working Example 1

Three hairs, which were made of PPS resin with a length of 250 mm and a diameter of 0.15 mm and had a substantially circular section and a substantially uniform diameter in the length direction, were prepared, and a tensile test was performed one by one through the method described below.

Figure 2:
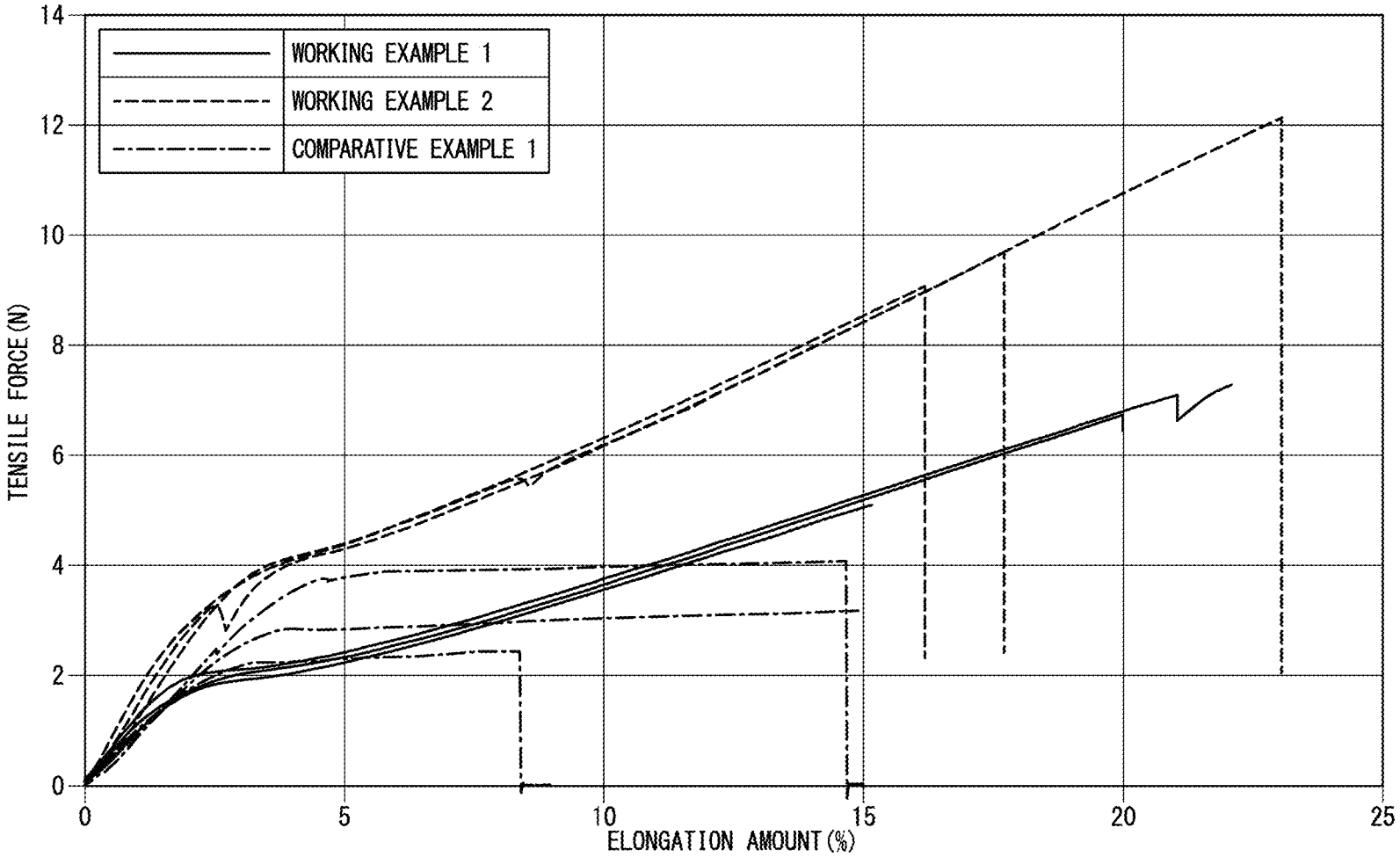
FIG. 2 is a graph showing results of tensile tests of Working Examples 1 and 2 and Comparative Example 1.

The tensile test was performed at a test speed of 300 mm/min under a condition of a temperature of 25° C. In the tensile test, a tensile force was applied to the hair until the hair broke, and a relationship between the tensile force and the length of the elongated hair was investigated. The results are shown in FIG. 2.

Working Example 2

The tensile test was performed as in Working Example 1 except that hair, which was made of PPS resin with a length of 250 mm and a diameter of 0.20 mm and had a substantially circular section and a substantially uniform diameter in the length direction, was used, instead of the hair of Working Example 1. The results are shown in FIG. 2.

Comparative Example 1

The tensile test was performed as in Working Example 1 except that a horse hair with a diameter of 0.1 to 0.13 mm was used, instead of the hair of Working Example 1. The results are shown in FIG. 2.

FIG. 2 is a graph showing the results of the tensile tests of Working Examples 1 and 2 and Comparative Example 1. In FIG. 2, the horizontal axis represents an elongation amount [%] and the vertical axis represents a tensile force [N]. The value of the elongation amount [%] was calculated using the following equation.

Elongation amount [%]=(Difference in length before test and after test/Length before test)×100

As shown in FIG. 2, the tensile strength (tensile force when the hair was broken) of the hair (Working Example 1) made of PPS resin with a diameter of 0.15 mm was 5 to 7 N, and the tensile strength of the hair (Working Example 2) with a diameter of 0.20 mm was 9 to 12 N. On the other hand, the tensile strength of the horse hair (Comparative Example 1) was 2 to 4 N. From this, it could be confirmed that the hair made of PPS resin had high tensile strength compared to the horse hair.

Comparative Example 2

The tensile test was performed as in Working Example 1 except that hair (Comparative Example 2), which was made of PVDF with a diameter of 0.21 mm and had a substantially circular section and a substantially uniform diameter in the length direction was used, instead of the hair of Working Example 1.

For each of Working Examples 1 and 2 and Comparative Examples 1 and 2, the inclination of the tensile force-elongation curve in a range where a tensile force was 0.2 N or more and an elongation amount was 1% or less was calculated through the method described below.

Among the results of the tensile test on each type of hair, a regression line by the least squares method was acquired using the results in a range where a tensile force was 0.2 N or more and an elongation amount was 1% or less, and this was set as a least squares approximation formula of the tensile force-elongation curve of each type of hair. Then, an average value was calculated for each of the working examples and comparative examples from a numerical value of the inclination of the least squares approximation formula of each type of hair to acquire the inclination of the tensile force-elongation curve of each of the working examples and comparative examples.

Figure 3:
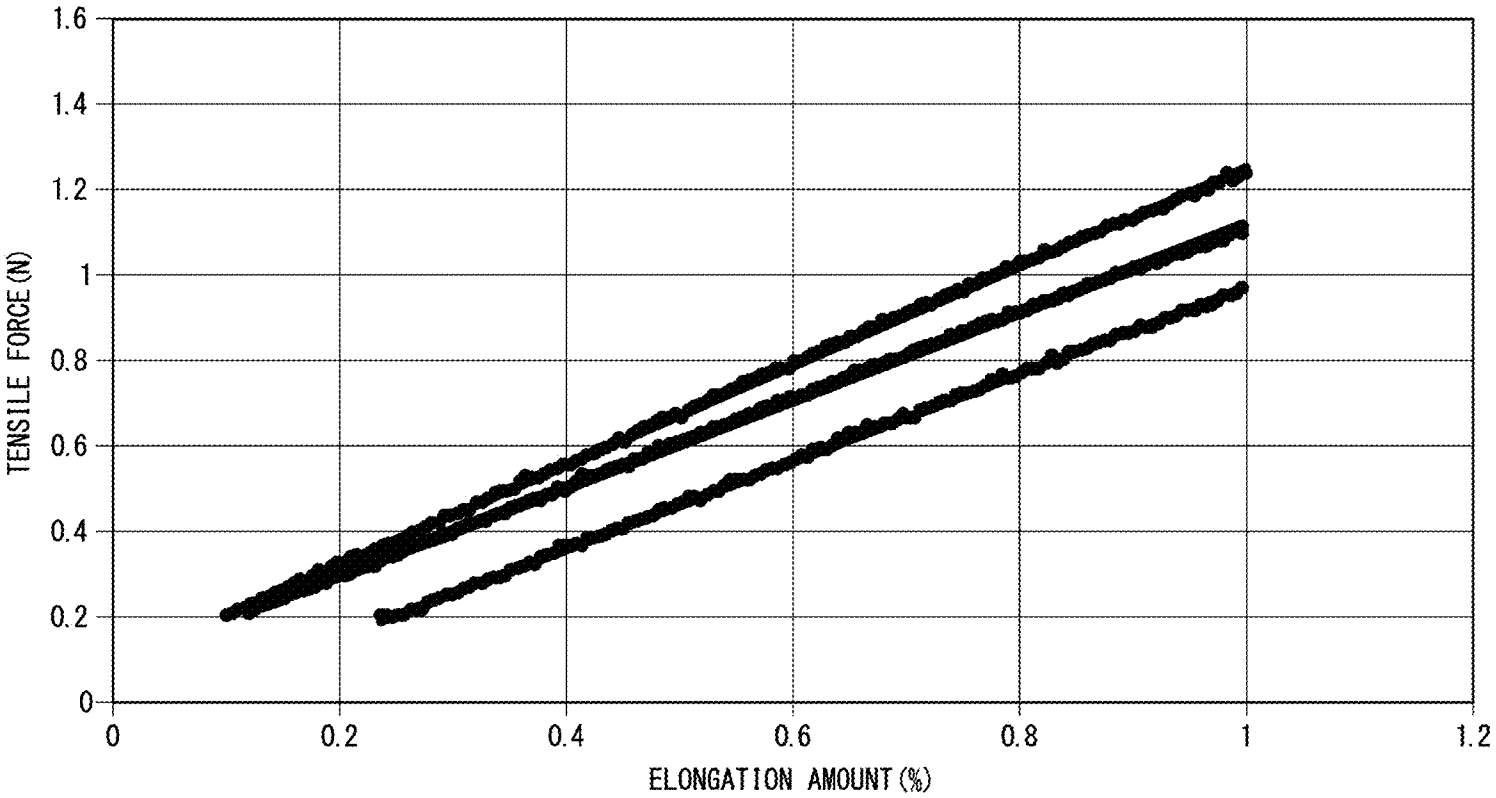
FIG. 3 shows some of the results of the tensile test of Working Example 1 (PPS resin with a diameter of 0.15 mm), and is an enlarged graph showing the results including a range where a tensile force is 0.2 N or more and an elongation amount (elongation) is 1% or less.
Figure 4:
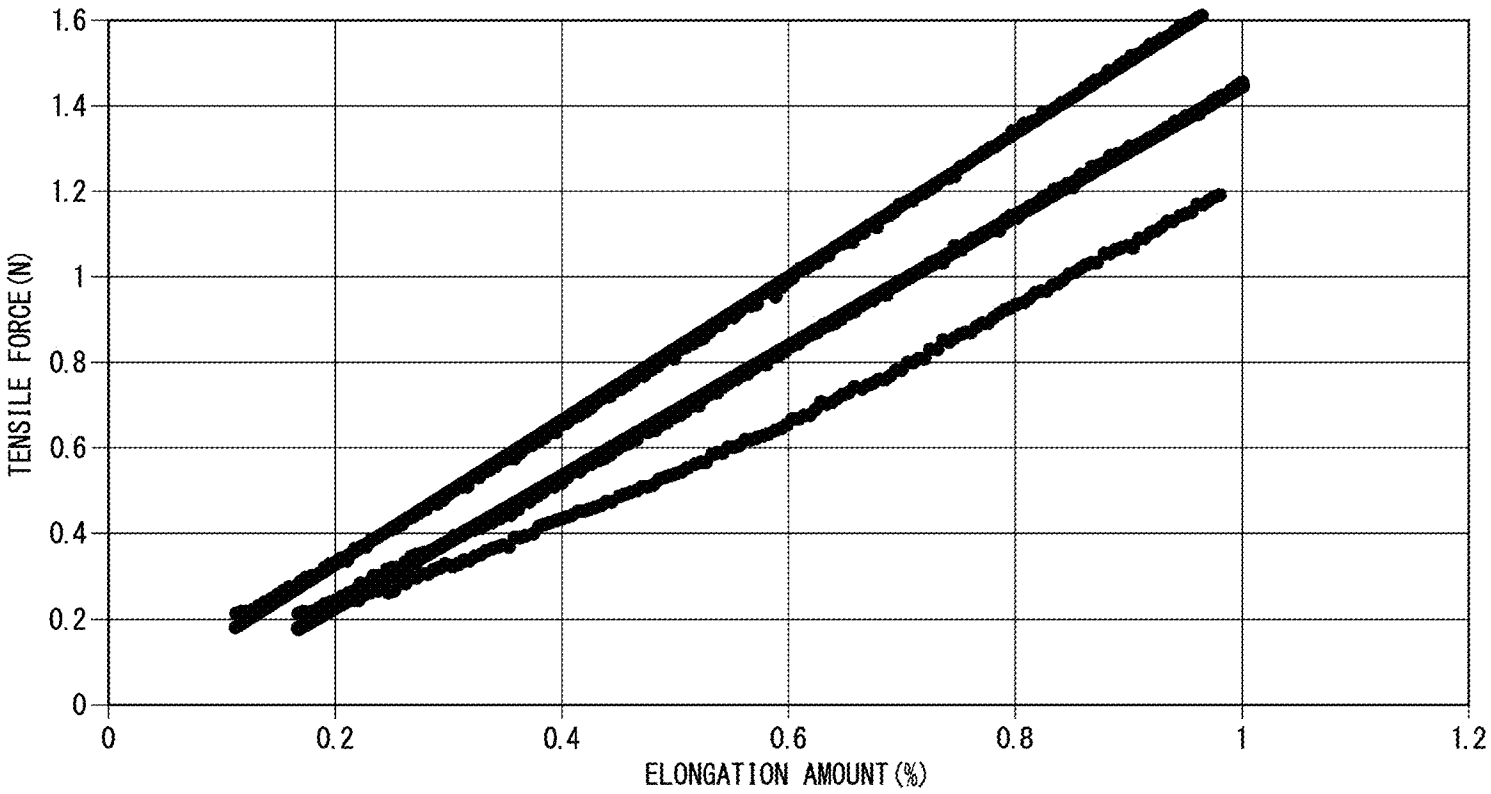
FIG. 4 shows some of the results of the tensile test of Working Example 2 (PPS resin with a diameter of 0.20 mm), and is an enlarged graph showing the results including the range where a tensile force is 0.2 N or more and an elongation amount is 1% or less.
Figure 5:
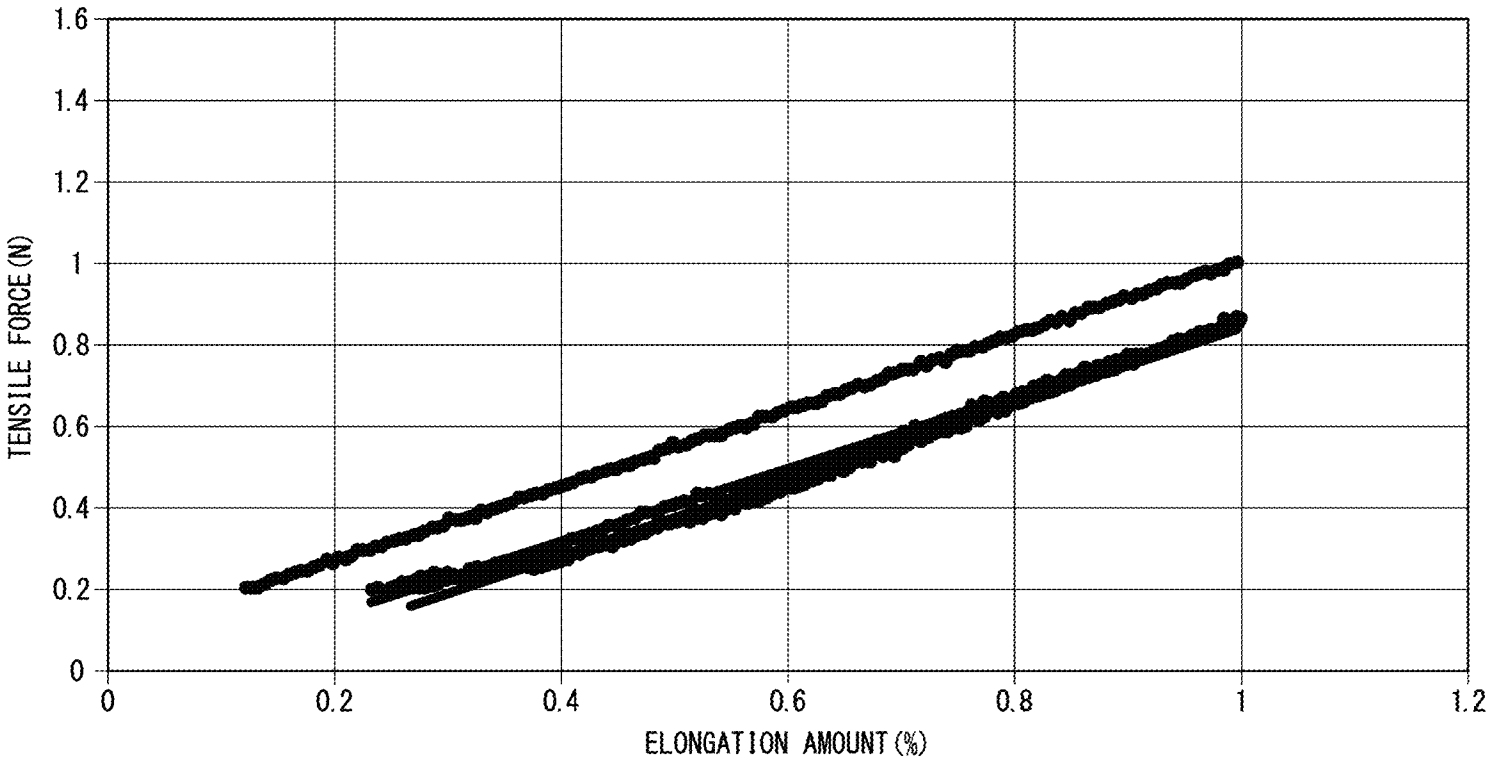
FIG. 5 shows some of the results of the tensile test of Comparative Example 1 (horse hair), and is an enlarged graph showing the results including the range where a tensile force is 0.2 N or more and an elongation amount is 1% or less.
Figure 6:
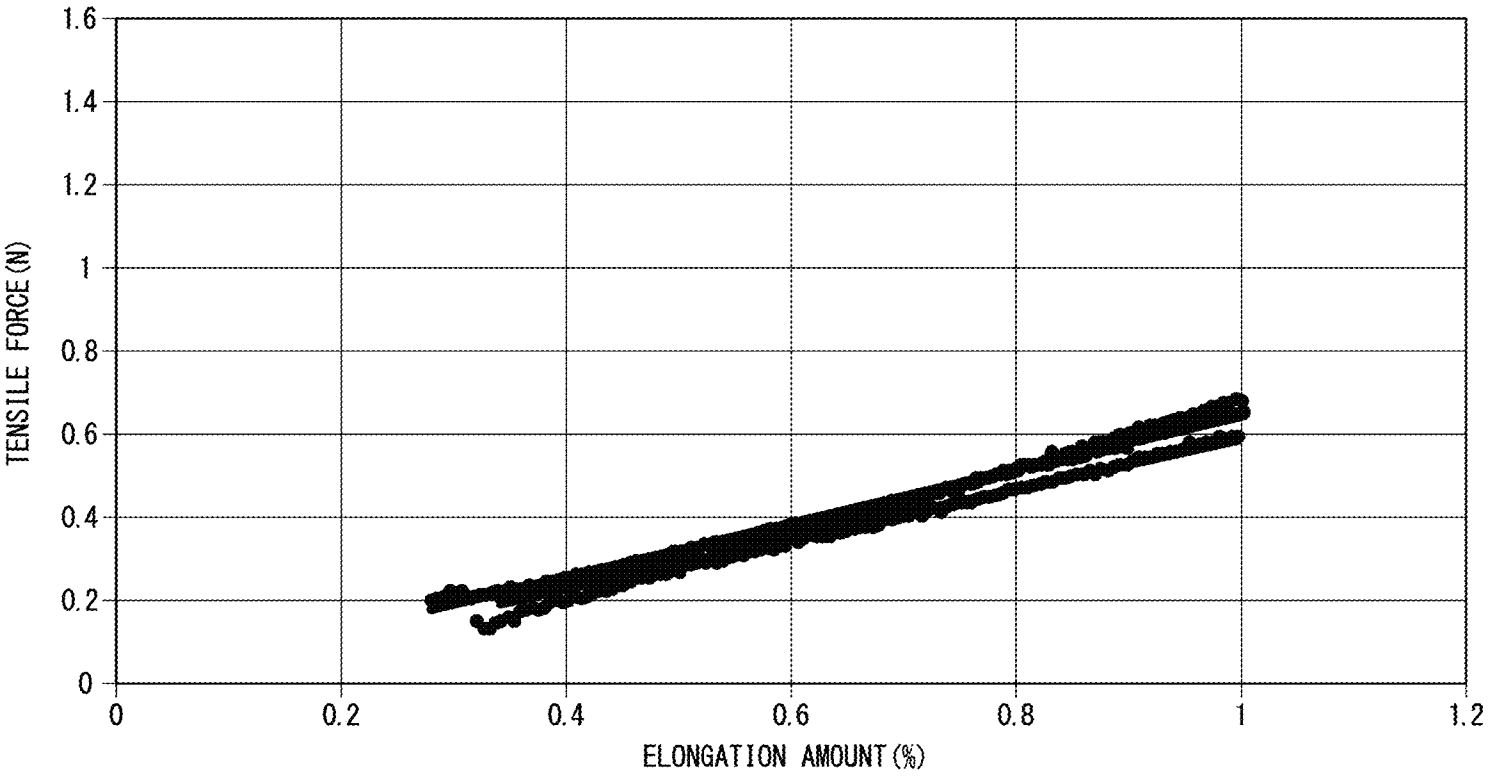
FIG. 6 shows some of the results of the tensile test of Comparative Example 2 (PVDF with a diameter of 0.21 mm), and is an enlarged graph showing the results including the range where a tensile force is 0.2 N or more and an elongation amount is 1% or less.

FIGS. 3 to 6 are some of the results of the tensile tests of Working Examples 1 and 2 and Comparative Examples 1 and 2. FIG. 3 is an enlarged graph showing the results of Working Example 1 (PPS resin with a diameter of 0.15 mm) including a range where a tensile force is 0.2 N or more and an elongation amount is 1% or less. FIG. 4 is an enlarged graph showing the results of Working Example 2 (PPS resin with a diameter of 0.20 mm) including a range where a tensile force is 0.2 N or more and an elongation amount is 1% or less. FIG. 5 is an enlarged graph showing the results of Comparative Example 1 (horse hair) including a range where a tensile force is 0.2 N or more and an elongation amount is 1% or less. FIG. 6 is an enlarged graph showing the results of Comparative Example 2 (PVDF with a diameter of 0.21 mm) including a range where a tensile force is 0.2 N or more and an elongation amount is 1% or less. In FIGS. 3 to 6, the horizontal axis represents an elongation amount [%] and the vertical axis represents a tensile force [N].

The inclination of the tensile force-elongation curve in a range where a tensile force was 0.2N or more and an elongation amount was 1% or less was 1.07 N/% for the hair (Working Example 1), which was made of PPS resin with a diameter of 0.15 mm, as shown in FIG. 3, 1.54 N/% for the hair (Working Example 2), which was made of PPS resin with a diameter of 0.20 mm, as shown in FIG. 4, 0.92 N/% for the horse hair (Comparative Example 1) as shown in FIGS. 5, and 0.68 N/% for the hair (Comparative Example 2) made of PVDF as shown in FIG. 6.

As described above, the hair of each of Working Examples 1 and 2 had the inclination of the tensile force-elongation curve within a range of 0.70 to 1.70 N/%, which was sufficiently similar to the horse hair (Comparative Example 1). For this reason, it is estimated that the bow for a bowed string instrument using the hair of each of Working Example 1 and Working Example 2 as a bow hair material has a tactile sense of playing and sound generation similar to the bow for a bowed string instrument using the horse hair as a bow hair material.

In addition, the inclination of the tensile force-elongation curve in a range where a tensile force was 0.2 N or more and an elongation amount was 1% or less was 1.07 N/% for the hair (Working Example 1) with a diameter of 0.15 mm, was 1.54 N/% for the hair (Working Example 2) with a diameter of 0.20 mm, and became higher as the hair became thicker. From this, it is understood that the average inclination can be adjusted by changing the thickness of the hair made of PPS resin.

On the other hand, it was understood that the hair of Comparative Example 2 had the inclination of the tensile force-elongation curve of 0.68 N/%, and was more likely to be elongated in a range of a tensile force applied to the bow hair during normal playing (0.3 N to 0.8 N) than the horse hair (Comparative Example 1) (refer to FIGS. 5 and 6). For this reason, the bow for a bowed string instrument that included the bow hair using the hair of Comparative Example 2 as a bow hair material had a tactile sense of playing and sound generation which were different from the bow for a bowed string instrument using the horse hair as a bow hair material, thereby greatly causing a feeling of strangeness.

In addition, the hair of Comparative Example 2 was made of PVDF with a diameter of 0.21 mm, and had the small average inclination (likely to be elongated) regardless of being thicker (a diameter of 0.21 mm) than the hair made of PPS resin (a diameter of 0.15 mm (Working Example 1) and a diameter of 0.20 mm (Working Example 2)). From this, it is necessary to make the hair thicker until the hair has a thickness not suitable as a bow hair material to obtain the hair which is made of PVDF and has the average inclination within a range of 0.70 to 1.70 N/%.

[Abrasion Test]

The bow for a bowed string instrument 1 illustrated in FIG. 1 was created using 150 hairs (the hair made of PPS resin with a diameter of 0.15 mm) of Working Example 1 as a material for the bow hair 5 through a general method which was implemented in a case where the horse hair was used as a material for the bow hair, and an abrasion test was performed through the method described below.

The tension of the bow hair 5 was set such that an interval from a central position of the bow hair 5 in the longitudinal direction to the stick 3 (a shortest distance between the bow hair 5 and the stick 3) was 8 mm. To the bow hair 5 of the bow for a bowed string instrument 1, 0.05 g of pine resin was applied.

Then, a surface of the bow hair 5 of the bow for a bowed string instrument 1, which was on an opposite side to the stick 3, and the D string, which was a violin string, were disposed to face each other, and the bow for a bowed string instrument 1 was fixed to an electric slider such that the length direction of the stick 3 was substantially perpendicular to an extending direction of the D string, which was a violin string. A rubbing position (position where the D string, which a violin string, was rubbed by the bow hair 5) was set to be substantially in the center between a fingerboard and a bridge of a violin.

After then, the bow for a bowed string instrument 1 was bowed by the electric slider, and the bow for a bowed string instrument 1 was reciprocated while rubbing the D string with the bow hair 5. The bowing speed by the electric slider was set to 50 mm/sec. The bowing range (in other words, a range of the bow hair 5 that came into contact with the D string) was set to a range of 5 cm with a point separated from the frog 13 by a third of the total length of the bow hair 5 as a center. As a pressure applied to the D string from the bow for a bowed string instrument 1, a weight having a total weight of 25 g was disposed on the stick 3 in the bowing range such that a load distribution in the bowing range was substantially equal.

Then, as for the hair of Working Example 1 used as a material for the bow hair 5, a relationship between the number of cut hairs and the number of reciprocations of the bow for a bowed string instrument 1 (the number of reciprocations for rubbing) was investigated. The results are shown in FIG. 7.

In addition, the abrasion test was performed in the same manner except that the horse hair of Comparative Example 1 was used, instead of the hair of Working Example 1. The results are shown in FIG. 7.

Figure 7:
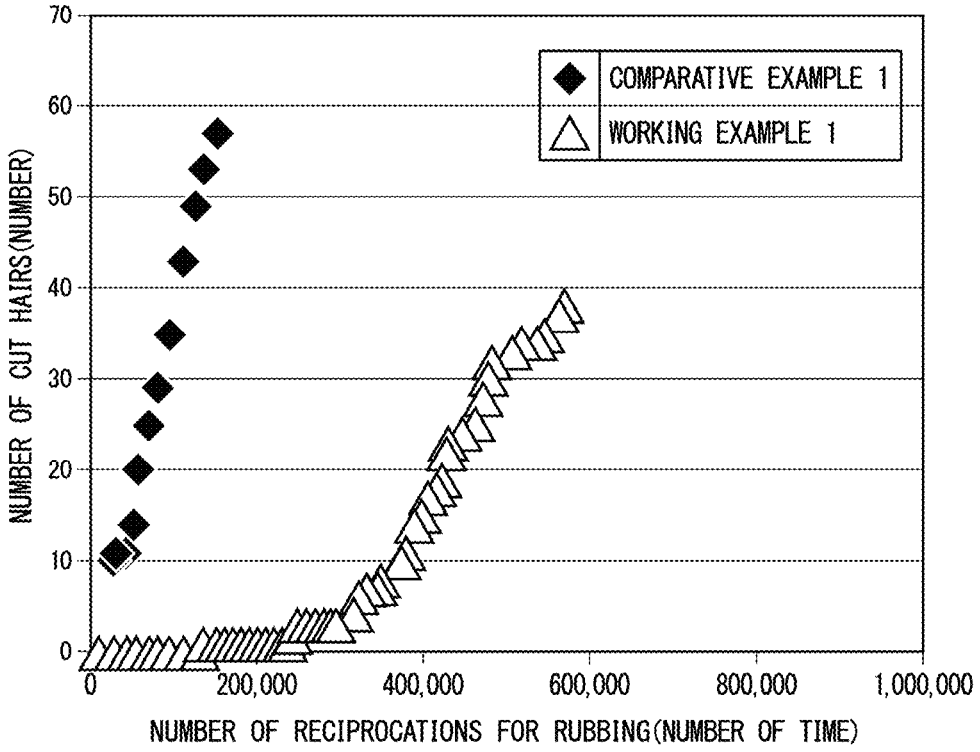
FIG. 7 is a graph showing results of abrasion tests of Working Example 1 and Comparative Example 1.

FIG. 7 is a graph showing the results of the abrasion tests of Working Example 1 and Comparative Example 1. In FIG. 7, the horizontal axis represents the number of reciprocations for rubbing [number of time] and the vertical axis represents the number of cut hairs [number].

As shown in FIG. 7, it is understood that the hair (Working Example 1) made of PPS resin with a diameter of 0.15 mm is unlikely to be cut compared to the horse hair (Comparative Example 1). Specifically, the number of reciprocations of the bow for a bowed string instrument until 30 hairs used as a material for the bow hair were cut (20% of the entire bow hair) was 480,000 times in Working Example 1, and was 82,000 times in Comparative Example 1.

From this, it could be confirmed that the hair made of PPS resin had good wear resistance compared to the horse hair.

[Elongation/Contraction Test]

(Elongation/Contraction Test Due to Difference in Dryness)

Two (Sample 1 and Sample 2) hairs (Working Example 1) made of PPS resin with a diameter of 0.15 mm were prepared, and an elongation/contraction test was performed through the method described below.

The length of the hair of Working Example 1 was measured before the test. After then, the hair of Working Example 1 was kept for 48 hours under conditions (dry conditions) of a temperature of 35° C. and humidity of 20%, and the length of the hair was measured in the same manner as before the test. The hair was further kept for 96 hours under the conditions (dry conditions) of a temperature of 35° C. and humidity of 20%, and the length of the hair was measured in the same manner as before the test (after 144 hours). The results are shown in Table 1. Next, the hair, which had been kept under the dry conditions, was kept for 48 hours under conditions (wet conditions) of a temperature of 35° C. and humidity of 95%, and the length of the hair was measured in the same manner as before the test (after 192 hours). The results are shown in Table 1.

The elongation/contraction test was performed in the same manner described above except that the horse hair of Comparative Example 1 was used, instead of the hair of Working Example 1. The results are shown in Table 1.

The elongation/contraction test was performed in the same manner described above except that the hair (Comparative Example 2) made of PVDF with a diameter of 0.21 mm was used, instead of the hair of Working Example 1. The results are shown in Table 1.

As for the length of the hair of each of Example 1 and Comparative Examples 1 and 2 measured in such a manner, a maximum value, a minimum value, a change amount (a difference between the maximum value and the minimum value), and a change rate ({the difference between the maximum value and the minimum value/the length before the test)}×100(%)) for each sample were acquired. The results are shown in Table 1.

TABLE 1

| | | WORKING EXAMPLE 1 | | COMPARATIVE EXAMPLE 1 | | COMPARATIVE EXAMPLE 2 | |
|---|---|---|---|---|---|---|---|
| | | SAMPLE 1 | SAMPLE 2 | SAMPLE 1 | SAMPLE 2 | SAMPLE 1 | SAMPLE 2 |
| | BEFORE TEST (mm) | 540 | 540 | 543 | 540 | 539.5 | 538 |
| DRY CONDITIONS (35° C. AND 20%) | AFTER 48 HOURS (mm) | 539.5 | 539.5 | 539.5 | 538 | 538.5 | 537.5 |
| DRY CONDITIONS (35° C. AND 20%) | AFTER 144 HOURS (mm) | 539.5 | 539 | 539 | 538 | 538.5 | 537.5 |
| WET CONDITIONS (35° C. AND 20%) | AFTER 192 HOURS (mm) | 539 | 538.5 | 545.5 | 541.5 | 538.5 | 537.5 |
| | MAXIMUM VALUE (mm) | 540 | 540 | 545.5 | 541.5 | 539.5 | 538 |
| | MINIMUM VALUE (mm) | 539 | 538.5 | 539 | 538 | 538.5 | 537.5 |

TABLE 1-continued

| | WORKING EXAMPLE 1 | | COMPARATIVE EXAMPLE 1 | | COMPARATIVE EXAMPLE 2 | |
|---|---|---|---|---|---|---|
| | SAMPLE 1 | SAMPLE 2 | SAMPLE 1 | SAMPLE 2 | SAMPLE 1 | SAMPLE 2 |
| CHANGE AMOUNT (mm) | 1 | 1.5 | 6.5 | 3.5 | 1 | 0.5 |
| CHANGE RATE (%) | 0.19 | 0.28 | 1.20 | 0.65 | 0.19 | 0.09 |

As shown in Table 1, the hair (Working Example 1) made of PPS resin and the hair (Comparative Example 2) made of PVDF contracted under both of the dry conditions and the wet conditions, but the change rate was 0.3% or less.

On the other hand, the horse hair (Comparative Example 1) contracted under the dry conditions and elongated under the wet conditions. In addition, the horse hair (Comparative Example 1) had a high change rate compared to Working Example 1 and Comparative Example 2.

From this, it could be confirmed that the hair made of PPS resin and the hair made of PVDF had good stability of length dimension depending on a humidity change compared to the horse hair.

(Elongation/Contraction Test at 70° C.)

Two (Sample 3 and Sample 4) hairs (Working Example 1) made of PPS resin with a diameter of 0.15 mm were prepared, and an elongation/contraction test was performed through the method described below.

The length of the hair of Working Example 1 was measured at the room temperature before the test. After then, the hair of Working Example 1 was kept for 5 hours under conditions of a temperature of 70° C. and humidity of 30%, and the length of the bow hair material was measured in the same manner as before the test. The hair was further kept for 21 hours under the conditions of a temperature of 70° C. and humidity of 30%, and the length of the bow hair material was measured in the same manner as before the test (after 26 hours). The results are shown in Table 2.

The elongation/contraction test was performed in the same manner described above except that the hair (Comparative Example 2) made of PVDF with a diameter of 0.21 mm was used, instead of the hair of Working Example 1. The results are shown in Table 2.

As for the length of the bow hair material measured in such a manner, a difference (mm) between a maximum value and a minimum value and an elongation/contraction rate ({the difference between the maximum value and the minimum value/the length before the test}×100(%)) were acquired. The results are shown in Table 2.

TABLE 2

| | | WORKING EXAMPLE 1 | | COMPARATIVE EXAMPLE 1 | |
|---|---|---|---|---|---|
| | | SAMPLE 3 | SAMPLE 4 | SAMPLE 3 | SAMPLE 4 |
| | BEFORE TEST (mm) | 551 | 540 | 562.5 | 537 |
| 70° C. AND 30% | AFTER 5 HOURS (mm) | 550 | 540 | 552 | 531 |

TABLE 2-continued

| | | WORKING EXAMPLE 1 | | COMPARATIVE EXAMPLE 1 | |
|---|---|---|---|---|---|
| | | SAMPLE 3 | SAMPLE 4 | SAMPLE 3 | SAMPLE 4 |
| 70° C. AND 30% | AFTER 26 HOURS (mm) | 550 | 540 | 550 | 526 |
| DIFFERENCE (mm) | | 1 | 0 | 12.5 | 11 |
| ELONGATION/ CONTRACTION RATE(%)AT 70° C. | | 0.2 | 0.0 | 2.2 | 2.0 |

As shown in Table 2, the elongation/contraction rate of the hair (Working Example 1) made of PPS resin was 0.3% or less. The hair made of PPS resin had a small elongation/contraction rate of the length dimension compared to the hair (Comparative Example 2) made of PVDF.

From this, it could be confirmed that the hair made of PPS resin had good stability of the length dimension at 70° C. compared to the hair made of PVDF. In addition, it was understood that the hair made of PPS resin was preferable as a material for the bow hair since the hair had good stability of the length.

In addition, as shown in Table 2, no difference was observed between the results after 5 hours and the results after 26 hours for the hair made of PPS resin. From this, it was understood that the hair made of PPS resin reached a steady state in a time of less than 5 hours under conditions of a temperature of 70° C. and humidity of 30%. In addition, it was understood that the elongation/contraction rate of the hair made of PPS resin which reached the steady state was sufficiently small and did not cause a quality problem in a case of being used as a material for the bow hair.

[Adherability of Pine Resin]

As in the abrasion test, the bow for a bowed string instrument 1 was created using the hair (Working Example 1) made of PPS resin with a diameter of 0.15 mm as a material for the bow hair 5. The tension of the bow hair 5 was set such that an interval from a central position of the bow hair 5 in the longitudinal direction to the stick 3 (a shortest distance between the bow hair 5 and the stick 3) was 8 mm.

Then, as for the bow for a bowed string instrument 1, each time pine resin came into contact with the bow hair 5 to reciprocate once over a predetermined range of the bow hair 5 in the length direction, the mass of the adhered pine resin was measured and the adherability of pine resin was investigated. The range in which pine resin came into contact with the bow hair 5 to reciprocate was a range of 15 cm in length. The results are shown in FIG. 8.

The adherability of pine resin was investigated in the same manner described above except that each of the horse hair of Comparative Example 1, the hair (Comparative Example 2) made of PVDF with a diameter of 0.21 mm, and hair (Comparative Example 3) made of commercially available nylon was used, instead of the hair of Working Example 1. The results are shown in FIG. 8.

Figure 8:
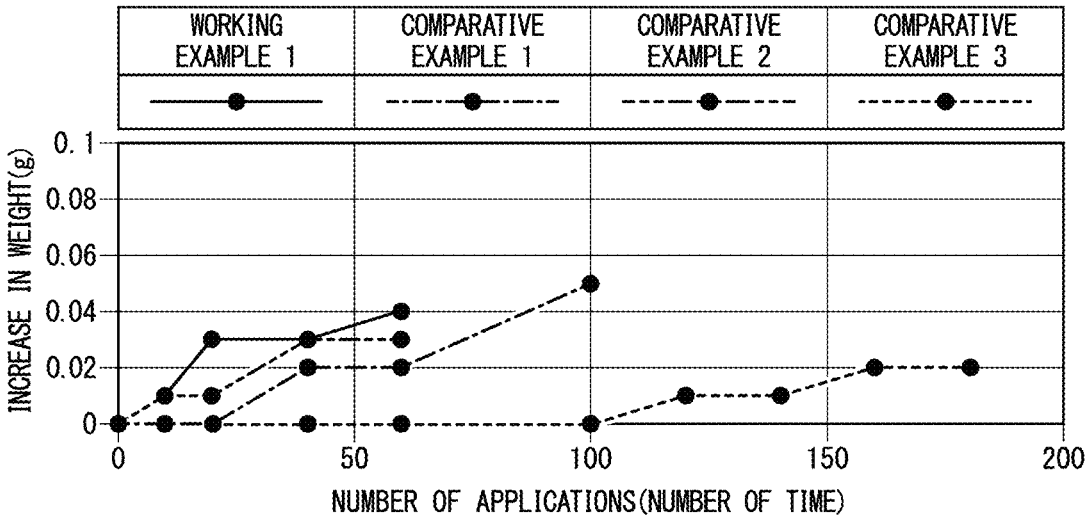
FIG. 8 is a graph showing adherability of pine resin on a bow hair.

FIG. 8 is a graph showing the adherability of pine resin on the bow hair. In FIG. 8, the horizontal axis represents the number of reciprocations (number of applications) [number of time] and the vertical axis represents an increase in weight [g].

As shown in FIG. 8, it could be confirmed that both of the hair (Working Example 1) made of PPS resin with a diameter of 0.15 mm and the hair (Comparative Example 2) made of PVDF with a diameter of 0.21 mm were likely to allow pine resin to adhere thereto to an equal or higher degree than to the horse hair (Comparative Example 1). On the other hand, the hair (Comparative Example 3) made of nylon was unlikely to allow pine resin to adhere thereto.

In addition, the bow hair 5 of the bow for a bowed string instrument 1 using the hair (Working Example 1) made of PPS resin with a diameter of 0.15 mm came into contact with pine resin to reciprocate a plurality of times, and the pine resin was adhered to the bow hair 5. A violin was played using the bow for a bowed string instrument 1 and sound generation was checked. As a result it was confirmed that the amount of the pine resin adhered to the bow hair 5 was sufficient. After then, one hair of Working Example 1 was taken from the bow hair 5 of the bow for a bowed string instrument 1 and was imaged with an optical electron microscope. The results are shown in FIG. 9.

Figure 9:
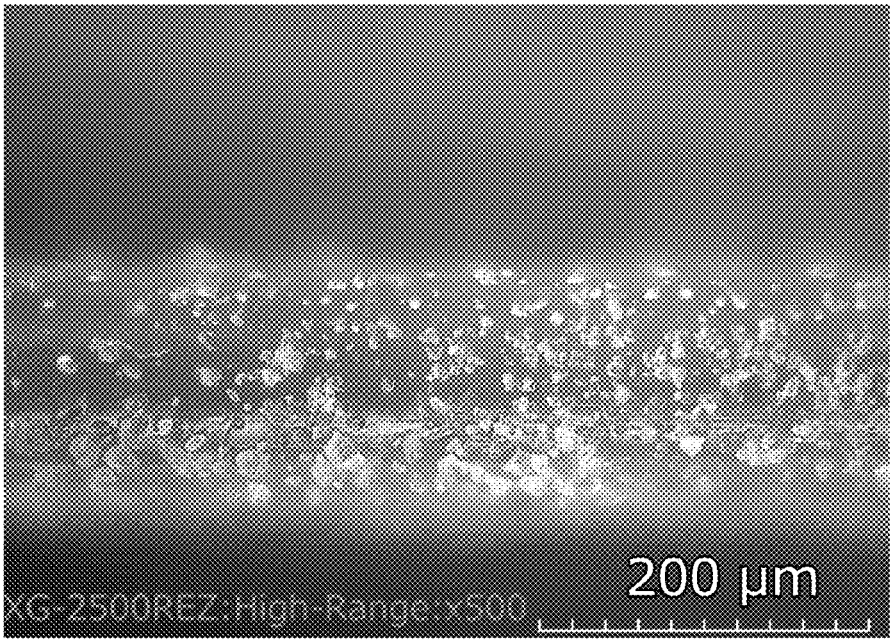
FIG. 9 is a photograph obtained by imaging hair of Working Example 1 to which pine resin is adhered.

FIG. 9 is a photograph obtained by imaging the hair of Working Example 1 to which the pine resin is adhered. As shown in FIG. 9, the pine resin was substantially uniformly adhered to the hair (Working Example 1) made of PPS resin with a diameter of 0.15 mm.

[Playability]

The bow for a bowed string instrument 1 was created as in the abrasion test, using each of the hair (Working Example 1) made of PPS resin with a diameter of 0.15 mm, the hair (Working Example 2) made of PPS resin with a diameter of 0.20 mm, hair (Working Example 3) made of PPS resin with a diameter of 0.25 mm, the horse hair (Comparative Example 1), the hair (Comparative Example 2) made of PVDF with a diameter of 0.21 mm, and the hair (Comparative Example 3) made of commercially available nylon as a material for the bow hair 5, and pine resin was applied to the bow hair 5.

After then, a violin was played using each bow for a bowed string instrument 1 having the bow hair 5 made of a different material, and playability was evaluated. Playing and evaluation were performed by a professional violinist. The results are as follows.

(Working Example 1) The sound feels light when playing.

(Working Example 2) The sound is bright and crisp. Easy to play.

(Working Example 3) The sound feels powerful. Optimal for bright songs. Unsuitable for songs that require fine operability.

(Comparative Example 1) Has appropriate elasticity and has strength.

(Comparative Example 2) Has a bright sound, but elasticity is low and the sound is hard when playing.

(Comparative Example 3) There is a feeling of strangeness and noise from a harsh sound when playing.

From the description above, it was understood that the hair (Working Examples 1 to 3) made of PPS resin not only had playability comparable to that of the horse hair of Comparative Example 1, but also had a possibility of having playability superior to that of the horse hair and thereby it may provide new values for the player.

The present subject matter may be applied to the bow hair of the bow for a bowed string instrument.

A bow hair material according to an embodiment of the present subject matter is used for a bow hair of a bow for a bowed string instrument, and includes hair including poly phenylene sulfide (PPS) resin.

In the bow hair material according to the embodiment of the present subject matter, it is preferable that a diameter of the hair be 0.1 to 0.3 mm.

In the hair of the bow hair material according to the embodiment of the present subject matter, it is preferable that an inclination of a tensile force-elongation curve of the hair within a range where a tensile force is 0.2 N or more and an elongation amount is 1% or less be from 0.70 to 1.70 N/%.

In the hair of the bow hair material according to the embodiment of the present subject matter, it is preferable that a change amount of the hair in a length dimension, which is caused by a humidity change, be 0.5% or less.

In the hair of the bow hair material according to the embodiment of the present subject matter, it is preferable that an elongation/contraction rate of a length of the hair that has been kept at 70° C. with respect to a length of the hair at room temperature be 0.5% or less.

It is preferable that the bow hair material according to the embodiment of the present subject matter further include a hair bundle that includes a plurality of hairs including the hair, the plurality of hairs being substantially parallel with each other, and a mounting portion be formed by welding an end portion of the hair bundle and be used for mounting the hair bundle on a frog of the bow or a stick of the bow.

A bow for a bowed string instrument according to another embodiment of the present subject matter includes: a stick; and a bow hair on which any one of the above-mentioned bow hair material is mounted.

A manufacturing method of a bow hair material used for a bow hair of a bow for a bowed string instrument according to still another embodiment of the present subject matter the method includes: forming a hair bundle that includes a plurality of hairs including poly phenylene sulfide resin, the plurality of hairs being substantially parallel with each other; and welding an end portion of the hair bundle to form a mounting portion for mounting the hair bundle on a frog of the bow or a head of a stick of the bow.

The bow hair material according to the embodiment of the present subject matter includes the hair including PPS resin. For this reason, the bow hair material according to the embodiment of the present subject matter has good durability compared to the hair of the tail of the horse.

In addition, the bow hair material according to the embodiment of the present subject matter undergoes a small dimensional change caused by a temperature change. For this reason, in the bow for a bowed string instrument that includes the bow hair using the bow hair material according to the embodiment of the present subject matter, it is possible to prevent the stick being deformed or broken due to a force generated by pulling by the bow hair that is applied to the stick due to the contraction of the bow hair caused by a temperature change.

In addition, the bow hair material according to the embodiment of the present subject matter undergoes a small dimensional change caused by a humidity change. For this reason, a change in the length of the bow hair caused by a humidity change is small. Therefore, even when the length of the bow hair changes due to the humidity change, the bow for a bowed string instrument that includes the bow hair using the bow hair material according to the embodiment of the present subject matter can adjust the tension of the bow hair to tension suitable for playing, for example, by rotating the screw.

From these, the bow hair material according to the embodiment of the present subject matter is suitable for specific application of using the bow hair of the bow for a bowed string instrument.

Since the bow for a bowed string instrument according to the embodiment of the present subject matter includes the stick and the bow hair on which the bow hair material according to the embodiment of the present subject matter is mounted, the durability of the bow hair is good, and a dimensional change of the bow hair caused by a humidity change and a temperature change decreases, which is preferable.

What is claimed is:

1. A bow hair material for a bow hair of a bow of a bowed string instrument, the bow hair material comprising:

a hair bundle that includes a plurality of threads, the plurality of threads comprising a poly phenylene sulfide resin thread, the plurality of threads being substantially parallel with each other, wherein an end portion of the hair bundle is welded and is formed as a mounting portion for mounting the hair bundle on a frog of the bow or a head of a stick of the bow, and a diameter of each of the plurality of threads is 0.1 to 0.3 mm.

2. The bow hair material according to claim 1, wherein an inclination of a tensile force-elongation curve of the thread is within a range of 0.70 to 1.70 N/%, where a tensile force is 0.2 N or more and an elongation amount is 1% or less.

3. The bow hair material according to claim 1, wherein a change in length of the thread caused by humidity is 0.5% or less.

4. The bow hair material according to claim 1, wherein an elongation/contraction rate in length of the thread that has been kept at 70° C. when compared with a length of another thread at room temperature is 0.5% or less.

5. The bow hair material according to claim 1, further comprising:

a hair bundle that includes a plurality of threads including the thread, the plurality of threads being substantially parallel with each other, wherein a mounting portion is formed by welding an end portion of the hair bundle, which mounts the hair bundle on a frog of the bow or a stick of the bow.

6. A bow for a bowed string instrument comprising:

a stick; and a bow hair comprising the bow hair material according to claim 1 and mounted on the stick.

7. A manufacturing method of a bow hair material for a bow hair of a bow of a bowed string instrument, the method comprising:

forming a hair bundle that includes a plurality of threads, the plurality of threads comprising poly phenylene sulfide resin, the plurality of threads being substantially parallel with each other; and welding an end portion of the hair bundle to form a mounting portion for mounting the hair bundle on a frog of the bow or a head of a stick of the bow, wherein a diameter of each of the plurality of threads is 0.1 to 0.3 mm.

* * * * *